US005261845A

United States Patent [19]

Van Esdonk et al.

[11] Patent Number: 5,261,845

[45] Date of Patent: Nov. 16, 1993

[54] SCANDATE CATHODE

[75] Inventors: Johannes Van Esdonk; Jan Hasker; Josef Van Lith, all of Eindhoven, Netherlands

[73] Assignee: U.S. Philips Corporation, New York, N.Y.

[21] Appl. No.: 738,061

[22] Filed: Jul. 30, 1991

Related U.S. Application Data

[63] Continuation of Ser. No. 215,696, Jul. 5, 1988, abandoned.

[30] Foreign Application Priority Data

Jul. 6, 1987 [NL] Netherlands ..... 8701583

[51] Int. Cl.[5] ..... H01J 9/04

[52] U.S. Cl. ..... 445/51; 445/51

[58] Field of Search ..... 445/36, 46, 49, 50, 445/51

[56] References Cited

U.S. PATENT DOCUMENTS 4,671,777 6/1987 van Esdonk et al. ..... 445/51

4,735,591 4/1988 Branovich et al. ..... 445/50

*Primary Examiner*—Kurt C. Rowan

*Attorney, Agent, or Firm*—Ernestine C. Bartlett

[57] ABSTRACT

A cathode body for an impregnated scandate cathode is obtained by compressing and sintering a mixture of tungsten powder with approximately 0.5% by weight of scandium, whereafter the body is impregnated.

12 Claims, 1 Drawing Sheet

SCANDATE CATHODE

This is a continuation of application Ser. No. 215,696, filed Jul. 5, 1988 now abandoned.

BACKGROUND OF THE INVENTION

The invention relates to a method of manufacturing a dispenser cathode comprising a barium compound for dispensing barium to an emissive surface of a porous cathode body substantially comprising a metal melting at a high temperature.

The invention also relates to a dispenser cathode manufactured by such a method and to an electron tube provided with such a cathode.

A characteristic feature of dispenser cathodes is that there is a functional separation between the electron emissive surface on the one hand and a store of emitter material on the other hand. The emitter material is present in the pores of the porous metal cathode body and is used for realizing a sufficiently low work function on the emissive surface.

A method of the type mentioned in the opening paragraph is described in U.S. Pat. No. 4,007,393. This patent describes how a cathode body with a porosity of approximately 20% is compressed from tungsten powder, sintered and impregnated with a mixture which comprises calcium oxide, aluminium oxide and scandium oxide in addition to barium oxide.

European Patent Specification No. 0,091,161, corresponding to U.S. Pat. No. 4,625,142, describes how sensitivity to and recovery from ion bombardment of such cathodes can be improved by forming the cathode body (notably the top layer) from a mixture of tungsten powder and scandium oxide powder which is compressed and sintered. To obtain a cathode body with a thin top layer (approximately 0.1 mm) which is as homogeneous as possible the compressing operation is generally performed in two steps. Firstly, the tungsten portion of the cathode body is slightly pre-compressed. Subsequently, the top layer powder is evenly distributed over a surface of the tungsten portion whereafter the definitive compressing operation is performed.

SUMMARY OF THE INVENTION

It is an object of the invention to provide a different method of manufacturing such a dispenser cathode, which method is simpler and leads to similar results as regards current density and lifetime.

To this end a method according to the invention is characterized in that the cathode body is compressed from a quantity of metal powder which is mixed with scandium or scandium hydride whereafter the body is sintered and the cathode is provided with emitter material. The quantity of scandium or scandium hydride in the quantity of metal powder is preferably 0.3–0.7% by weight From a manufacturing technical point of view such a method is more advantageous because compressing is performed in one operation and the distribution of the top-layer powder is thus no longer necessary. After the introduction of the impregnant, the cathode bodies manufactured by such a method can undergo mechanical treatments such as turning or other types of shaping without any detrimental effects.

In order to prevent as much as possible scandium loss during sintering (which is preferably performed in a hydrogen atmosphere), this sintering operation is preferably performed at a temperature which is lower than the melting point of scandium (1539° C.). However, on the other hand the sintering temperature must be chosen to be as high as possible in order to obtain a sufficiently robust cathode body.

A preferred embodiment of a method according to the invention is therefore characterized in that the sintering temperature is between 1430° C. and 1500° C.

BRIEF DESCRIPTION OF THE DRAWING

The invention will now be described in greater detail by way of example with reference to the accompanying drawing, in which.

DESCRIPTION OF THE PREFERRED EMBODIMENT

Figure 1:
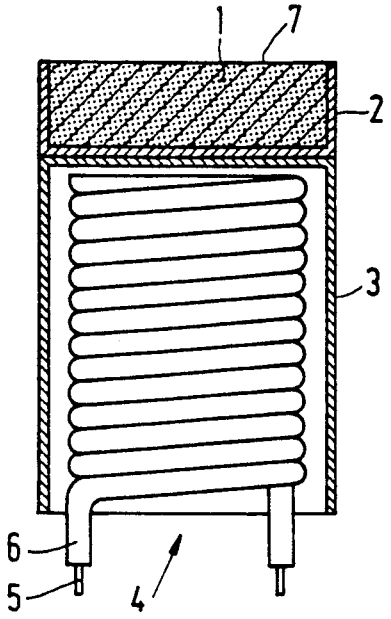
FIG. 1 is a longitudinal cross-section view of a cathode according to the invention and FIG. 2 is a perspective view of a cylindrical cathode according to the invention.

FIG. 1 is a longitudinal cross-section of a cathode according to the invention. The cathode body 1 is compressed from a mixture of tungsten powder and approximately 0.5% by weight of scandium or scandium hydride, for example, at a pressure of approximately 3.5 atmosphere and sintered in hydrogen for approximately one hour at 1450° C., after which it has a porosity of approximately 20%. The cathode body 1 now has, for example, a thickness of 0.5 mm and a diameter of approximately 1.8 mm.

Subsequently, the cathode body 1 is impregnated in a hydrogen atmosphere with a barium calcium aluminate (for example, $5BaO$; $2Al_2O_3$; $3CaO$ or $4BaO$; $1Al_2O_3$; $1CaO$), forced into a holder 2 which is welded onto cathode shank 3. The cathode shank 3 accommodates a coiled cathode filament 4 comprising a helically wound metal core 5 and an aluminium oxide insulating layer 6. Emission from the emissive surface 7 of such a cathode was approximately 100 $A/cm^2$ at 950° C. obtained at a pulse load of 1000 V in a diode with a cathode-anode distance of 0.3 mm. Such an emission is comparable to that of a cathode with a top layer of tungsten and scandium oxide as described in allowed U.S. patent application Ser. No. 899,788, filed Aug. 22, 1986, which is more difficult to manufacture. The recovery after ion bombardment was comparable to that of the cathode described in that Application with a cathode body sintered at approximately 1900° C. (approximately 65%). In a cathode according to the invention sintered at 1500° C., this recovery was poorer and was approximately 58%. For the significance of the recovery percentages and the way in which they have been determined, reference is made to the European Patent Application No. 0,178,716 or to the magazine Article by J. Hanker et al, "Properties and manufacture of top layer scandate cathodes", Applied Surface Science 26 (1986), pages 173–195.

In the above-mentioned example the impregnant absorption was approximately 4.5%. Upon raising the quantity of scandium or scandium hydride in the mixture to be compressed from about 0.5 to 1 percent by weight, this absorption decreased to approximately 2% which shortens the life time of the cathode. For a quantity of 0.3–0.7% by weight of scandium or scandium hydride the quantity of absorbed impregnant is sufficient; the recovery after ion bombardment did not show any significant change in this range.

Figure 2:
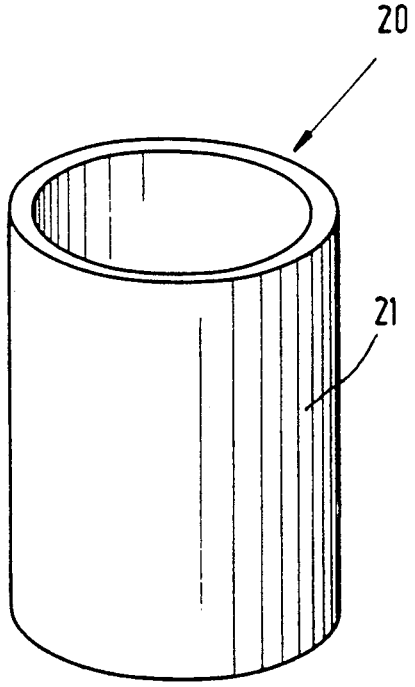

FIG. 2 shows an alternate embodiment of a cathode according to the invention, a cylinder 20 with ar emissive surface 21 in which a from a tungsten body compressed in accordance with the method as described hereinbefore. A heating element, not shown, may be provided within cylinder 20.

The cathodes according to the invention may be used in electron tubes such as, for example magnetrons, transmitter tubes, etc., but also in cathode-ray tubes for e.g. television applications and electron microscopy.

We claim:

1. A method of manufacturing a dispenser cathode comprising a barium compound for dispensing barium to an emissive surface of a porous cathode body substantially comprising a metal melting at a high temperature, characterized in that the cathode body is compressed from a quantity of metal powder which is mixed with scandium or scandium hydride in the amount of approximately 0.3 to 0.7% by weight of the powder mixture, whereafter the body is sintered and the cathode is provided with emitter material.

2. A method as claimed in claim 1, characterized in that the sintering temperature is lower than the melting point of scandium.

3. A method as claimed in claim 2, characterized in that the sintering temperature is 1430° C. and 1500° C.

4. A method as claimed in claim 1 characterized in that the cathode body is definitively shaped after it has been provided with emitter material.

5. A dispenser cathode produced by the method of claim 1.

6. A dispenser cathode produced by the method of claim 2.

7. A dispenser cathode produced by the method of claim 3.

8. A dispenser cathode produced by the method of claim 4.

9. A dispenser cathode comprising a barium compound for dispensing barium to an emissive surface of a porous cathode body substantially comprising a metal melting at a high temperature, the improvement wherein the cathode body is compressed from a quantity of metal powder which is mixed with scandium or scandium hydride in the amount of approximately 0.3 and 0.7% by weight.

10. A dispenser cathode as claimed in claim 9 where the cathode body is compressed in a one step operation, sintered and provided with emitter material.

11. A dispenser cathode as claimed in claim 10 wherein the sintering temperature is lower than the melting point of scandium.

12. A dispenser cathode as claimed in claim 11 in which the cathode body is definitively shaped after it has been provided with emitter material.

* * * * *